US011170656B2

(12) United States Patent
Gärtner et al.

(10) Patent No.: US 11,170,656 B2
(45) Date of Patent: Nov. 9, 2021

(54) PREDICTING LOW VISIBILITY SET-UP OPTIONS FOR AN AIRPORT MOVING MAP

(71) Applicant: THE BOEING COMPANY, Chicago, IL (US)

(72) Inventors: Marco Franz Gärtner, Hessen (DE); Daniel Artic, Hessen (DE)

(73) Assignee: The Boeing Company, Chicago, IL (US)

( * ) Notice: Subject to any disclaimer, the term of this patent is extended or adjusted under 35 U.S.C. 154(b) by 349 days.

(21) Appl. No.: 16/202,756

(22) Filed: Nov. 28, 2018

(65) Prior Publication Data

US 2020/0168109 A1 May 28, 2020

(51) Int. Cl.
*G08G 5/00* (2006.01)

(52) U.S. Cl.
CPC ..... *G08G 5/0091* (2013.01); *G08G 5/0026* (2013.01); *G08G 5/0043* (2013.01)

(58) Field of Classification Search
CPC .. G08G 5/0091; G08G 5/0026; G08G 5/0043; G08G 5/0021; G08G 5/0013; G08G 5/0008; G08G 5/06; G08G 5/065; G01C 21/00; G01C 21/34; G01C 21/3407; G01C 21/38
USPC ..... 701/120
See application file for complete search history.

(56) References Cited

U.S. PATENT DOCUMENTS 7,222,017 B2 * 5/2007 Clark ..... G01C 23/00 340/958
7,343,229 B1 * 3/2008 Wilson ..... G08G 5/0021 340/951
7,382,284 B1 * 6/2008 Armstrong ..... G08G 5/0021 340/958
7,693,621 B1 * 4/2010 Chamas ..... G08G 5/0021 701/16
7,876,238 B2 1/2011 Vandenbergh et al.
7,983,838 B1 * 7/2011 Mislan ..... G05D 1/0083 701/466
8,290,642 B2 10/2012 Hanson
8,560,149 B1 * 10/2013 Ganguli ..... G05D 1/0083 701/15
8,856,673 B1 * 10/2014 Dorfmann ..... G08G 5/025 715/771
9,076,327 B1 * 7/2015 Baiada ..... G08G 5/0043
9,384,586 B1 * 7/2016 McCusker ..... G08G 5/025
9,407,826 B1 * 8/2016 Tiana ..... G01S 13/953
9,428,056 B2 * 8/2016 Kneuper ..... B64D 43/00
9,446,855 B2 * 9/2016 Canale ..... G08G 5/0034
9,583,005 B2 * 2/2017 Kommuri ..... G08G 5/0052
(Continued)

*Primary Examiner* — Angelina Shudy
(74) *Attorney, Agent, or Firm* — Sage Patent Group

(57) ABSTRACT

A method for predicting a low visibility set-up option for an airport moving map includes determining a visibility at a particular airport and predicting a low visibility set-up option for an airport moving map for the particular airport in response to the visibility being below a predetermined value. The method also includes retrieving from a data storage device the low visibility set-up option for the airport moving map in response to predicting the low visibility set-up. The method additionally includes applying the low visibility set-up option to the airport moving map for the particular airport. The method further includes presenting the airport moving map on a display including geospatial low visibility information based on the low visibility set-up option.

20 Claims, 10 Drawing Sheets

(56) References Cited

U.S. PATENT DOCUMENTS 9,959,771 B1 * 5/2018 Carlson ..... G08G 5/0039
10,156,848 B1 * 12/2018 Konrardy ..... G01C 21/362
10,290,217 B1 * 5/2019 Ramachandra ..... G08G 5/0091
10,295,363 B1 * 5/2019 Konrardy ..... B60P 3/12
10,321,221 B1 * 6/2019 Quezada ..... H04R 1/1083
10,354,536 B1 * 7/2019 Hegranes ..... G08G 5/0013
10,593,214 B2 * 3/2020 Idupunur ..... G08G 5/0091
2004/0246178 A1 * 12/2004 Smith ..... G08G 5/0013 342/454
2005/0007261 A1 * 1/2005 Berson ..... G01C 23/00 340/945
2005/0080551 A1 * 4/2005 Ledingham ..... G06Q 10/025 701/120
2005/0283305 A1 * 12/2005 Clark ..... G01C 23/00 701/120
2007/0112511 A1 * 5/2007 Burfeind ..... G08G 5/0021 701/469
2007/0168122 A1 * 7/2007 Aspen ..... G08G 5/0021 701/431
2007/0222969 A1 * 9/2007 Millgard ..... G08G 5/0026 356/4.01
2007/0299611 A1 * 12/2007 Winkler ..... G08G 5/0021 701/301
2010/0161160 A1 * 6/2010 Wilson ..... G01C 23/005 701/15
2010/0305786 A1 * 12/2010 Boorman ..... G08G 5/025 701/16
2011/0257873 A1 * 10/2011 Lussiez ..... G01C 23/00 701/120
2012/0215388 A1 * 8/2012 Pepitone ..... G08G 5/025 701/14
2012/0274484 A1 * 11/2012 Zimmer ..... G08G 5/0013 340/945
2013/0027226 A1 * 1/2013 Cabos ..... G08G 5/0021 340/961
2013/0131888 A1 * 5/2013 Nutaro ..... G08G 5/065 701/1
2014/0104051 A1 * 4/2014 Breed ..... G01S 17/86 340/435
2014/0222257 A1 * 8/2014 Wyatt ..... G08G 5/02 701/16
2016/0052641 A1 * 2/2016 Olofinboba ..... G08G 5/0078 340/978
2016/0171899 A1 * 6/2016 Depare ..... G01C 21/20 701/120
2016/0376026 A1 * 12/2016 Baudson ..... G02B 27/0101 345/7
2017/0229022 A1 * 8/2017 Gurel ..... G06T 5/002
2018/0061243 A1 * 3/2018 Shloosh ..... G08G 5/0091
2018/0075757 A1 * 3/2018 Estes ..... G08G 5/025
2019/0043164 A1 * 2/2019 He ..... G02B 27/01
2019/0080617 A1 * 3/2019 Idupunur ..... G08B 7/06
2019/0213897 A1 * 7/2019 Jayathirtha ..... G08G 5/065
2019/0228668 A1 * 7/2019 Wang ..... G01C 21/3617
2019/0340940 A1 * 11/2019 Elkabetz ..... G08G 5/0091
2020/0090531 A1 * 3/2020 Baladhandapani .. G08G 5/0026
2020/0202726 A1 * 6/2020 Kestenbach ..... G08G 5/0065
2020/0238403 A1 * 7/2020 Ahn ..... C23C 14/0664

* cited by examiner

PREDICTING LOW VISIBILITY SET-UP OPTIONS FOR AN AIRPORT MOVING MAP

FIELD

The present disclosure relates to moving maps for aircraft navigation and more particularly to determining or predicting low visibility set-ups for an airport moving map.

BACKGROUND

In low visibility conditions, pilots of an aircraft today need to find and select an applicable low visibility chart, for example, a low visibility set-up for a particular airport from a list of all available low visibility charts in a container including all taxi charts for the particular airport. The charts may be stored in a container including a multiplicity of different flat files. Accordingly, the pilot needs to first identify which charts are the applicable low visibility charts for current conditions. The low visibility charts are identifiable by an index number or chart title. The pilot needs to select which of these low visibility charts may be applicable for the prevailing conditions. The list of available low visibility charts is not reduced to only those that are most likely to be used under the prevailing conditions. Additionally, the list of available low visibility charts can be substantial for an airport which significantly increases pilot workload.

SUMMARY

In accordance with an embodiment, a method for predicting a low visibility set-up option for an airport moving map includes determining, by a processor, a visibility at a particular airport. The method also includes predicting, by the processor, a low visibility set-up option for an airport moving map for the particular airport in response to the visibility being below a predetermined value. The method also includes retrieving, by the processor from a data storage device, the low visibility set-up option for the airport moving map in response to predicting the low visibility set-up. The method additionally includes applying, by the processor, the low visibility set-up option to the airport moving map for the particular airport. The method further includes presenting the airport moving map on a display including geospatial low visibility information based on the low visibility set-up option.

In accordance with another embodiment, a system for predicting a low visibility set-up option for an airport moving map includes a processor and a data storage device. The data storage device includes a multiplicity of set-ups for airport moving maps. The system also includes a display for presenting the airport moving map. The system additionally includes a first module and a second module both operable on the processor. The first module is configured to determine a visibility at a particular airport and the second module is configured to perform a set of functions. The set of functions include predicting a low visibility set-up option for an airport moving map for the particular airport in response to the visibility being below a predetermined value. The set of functions also include retrieving, from a data storage device, the low visibility set-up option for the airport moving map for the particular airport in response to predicting the low visibility set-up option. The set of functions additionally include applying the low visibility set-up option to the airport moving map for the particular airport. The set of functions further include presenting the airport moving map on the display including geospatial low visibility information based on the low visibility set-up option.

In accordance with an embodiment and any of the previous embodiments, predicting a low visibility set-up option for an airport moving map for the particular airport includes predicting one or more low visibility set—up options for the airport moving map for the particular airport in response to the visibility being below the predetermined value.

In accordance with an embodiment and any of the previous embodiments, the method and system further include receiving a group of conditions for determining the visibility at the particular airport.

In accordance with an embodiment and any of the previous embodiments, the group of conditions include weather conditions.

In accordance with an embodiment and any of the previous embodiments, the method and system further include receiving a set of parameters for retrieving the low visibility set-up option for the airport moving map for the particular airport.

In accordance with an embodiment and any of the previous embodiments, wherein predicting the low visibility set-up option include using the set of parameters. The set parameters include a runway visual range, a phase of flight, an active runway or active runways, a type of aircraft, and a runway configuration or which combination of runways are currently active.

In accordance with an embodiment and any of the previous embodiments, wherein the set of parameters are received from a source including at least one of a Digital Automatic Terminal Information Service (D-ATIS), an Automatic Dependent Surveillance Broadcast (ADS-B), a Meteorological Terminal Aviation Routine Weather Report (METAR), a Data Link Operational Terminal Information System (D-OTIS), a web service providing weather information and a web service providing historic air traffic control (ATC) clearances.

In accordance with an embodiment and any of the previous embodiments, the method and system further include presenting a message. The message indicates a low visibility was detected in response to the visibility being below the predetermined value. The method and system also include presenting an identity of the low visibility set-up option for the airport moving map for the particular airport. The method and system further include automatically applying the low visibility set-up option to the airport moving map for the particular airport in response to selecting activation of the low visibility set-up option for the airport moving map by a user.

In accordance with an embodiment and any of the previous embodiments, wherein predicting the low visibility set-up option for the airport moving map includes predicting multiple low visibility set-up options for the airport moving map for the particular airport in response to the visibility being below the predetermined value.

In accordance with an embodiment and any of the previous embodiments, wherein predicting the multiple low visibility set-up options for the airport moving map includes using a set of parameters. The set of parameters including a runway visual range, a phase of flight, an active runway or active runways, a type of aircraft, and a runway configuration or which combination of runways are currently active.

In accordance with an embodiment and any of the previous embodiments, the method and system further include presenting a message. The message indicates a low visibility was detected in response to the visibility being below the predetermined value. The method and system additionally include presenting an indication that the multiple low visibility set-up options were retrieved in response to predicting more than one low visibility set-up option for the airport moving map for the particular airport.

In accordance with an embodiment and any of the previous embodiments, the method and system also include presenting a map filters panel including an identity of each of the multiple low visibility set-up options. The map filters panel is presented in response to activating a feature by a user to show the multiple low visibility set-up options. The method and system additionally include automatically applying a certain low visibility set-up option of the multiple low visibility set-up options to the airport moving map in response to the certain low visibility set-up option being selected by the user from the multiple low visibility set-up options in the map filters panel.

The features, functions, and advantages that have been discussed can be achieved independently in various embodiments or may be combined in yet other embodiments further details of which can be seen with reference to the following description and drawings.

DETAILED DESCRIPTION

Figure 1:
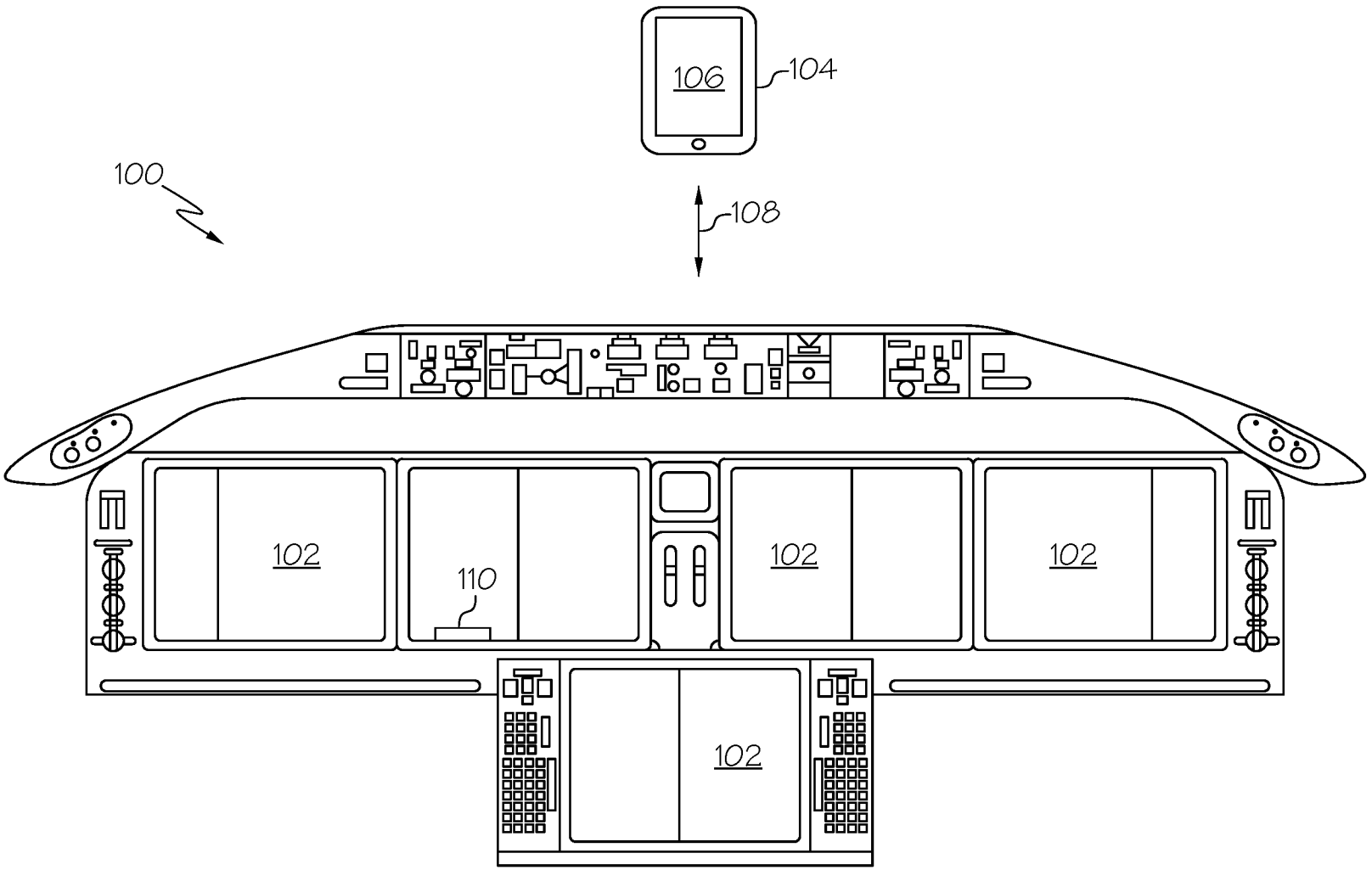
FIG. 1 is an illustration of an example of an aircraft cockpit display panel including at least one display in accordance with an embodiment of the present disclosure.

The following detailed description of embodiments refers to the accompanying drawings, which illustrate specific embodiments of the disclosure. Other embodiments having different structures and operations do not depart from the scope of the present disclosure. Like reference numerals may refer to the same element or component in the different drawings.

FIG. 1 is an illustration of an example of an aircraft cockpit display panel 100 including at least one display 102 in accordance with an embodiment of the present disclosure. In accordance with the example illustrated in FIG. 1, the aircraft cockpit display panel 100 includes a plurality of displays 102. During operation of an aircraft, such as exemplary aircraft 200 in FIG. 2, the aircraft cockpit display panel 100 and the display 102 or plurality of displays 102 are available for viewing by a pilot and/or co-pilot of the aircraft 200. In accordance with an example, a portable electronic device (PED) 104 including a display 106 is also associated with the aircraft cockpit display panel 100. A connection 108 is established between the PED 104 and the aircraft cockpit display panel 100. In another example, the PED 104 is removably attachable to the aircraft cockpit display panel 100 by any suitable mounting 110. As described in more detail herein, an airport moving map, for example, airport moving map 400 in FIGS. 4A and 4B or airport moving map 500 in FIGS. 5A-5D are presentable on the display 102, on more than one display 102 of the exemplary aircraft cockpit display panel 100 and/or display 106 of one or more PEDs 104 in FIG. 1. As described with reference to FIGS. 4A-4B and FIGS. 5A-5D, features for presenting a message indicating a low visibility and presenting the airport moving map including a low visibility set-up option applied to the airport moving map are presented on at least one display 102 and display 106 of the PED 104 or PEDs.

Figure 2:
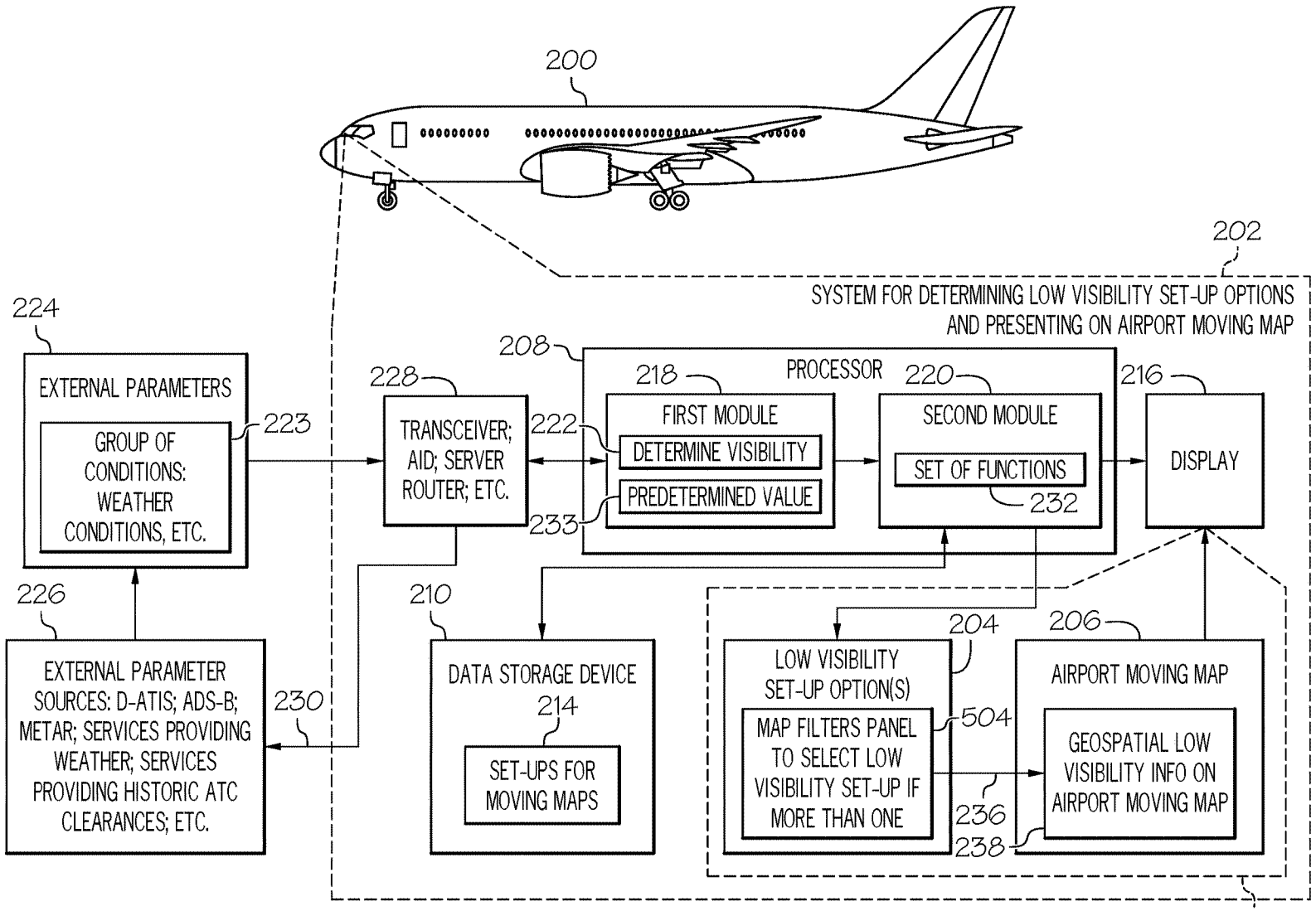
FIG. 2 is a block schematic diagram of an example of an aircraft including a system for predicting a low visibility set-up option for an airport moving map in accordance with an embodiment of the present disclosure.

FIG. 2 is a block schematic diagram of an example of an aircraft 200 including a system 202 for predicting or determining a low visibility set-up option 204 for an airport moving map 206 in accordance with an embodiment of the present disclosure. The system 202 includes a processor 208 and a data storage device 210. The data storage device 210 includes a multiplicity of set-ups 214 for airport moving maps 206. The system 202 also includes a display 216 for presenting the airport moving map 206. In accordance with an example, the display 216 is one or more displays 102 in FIG. 1.

The system 202 also includes a first module 218 and a second module 220 both operable on the processor 208. The first module 218 is configured to determine or detect a visibility 222 at a particular airport 408 (FIG. 4A-4B) from a group of conditions 223. An example of the group of conditions includes at least weather conditions at the particular airport 408. A runway configuration condition is also determined at the particular airport 408. In accordance with an example, the group of conditions 223 are part of a set of parameters 224 for predicting or determining one or more low visibility set-up options 204 for an airport moving map 206. In another example, the group of conditions 223 for detecting or determining the visibility 222 are received separate from the set of parameters 224. The set of parameters 224 include external parameters that are received from one or more external parameter sources 226. Examples of the parameters 224 include but are not necessarily limited to weather conditions at the particular airport 408, a runway visual range at the particular airport 408, a phase of flight of the aircraft 200, an active runway or active runways at the particular airport 408, a type of aircraft 200, and a runway configuration or which combination of runways are currently active at the particular airport 408. Examples of external parameter sources 226 include but are not necessarily limited to a Digital Automatic Terminal Information Service (D-ATIS), an Automatic Dependent Surveillance Broadcast (ADS-B), a Meteorological Terminal Aviation Routine Weather Report (METAR), a Data Link Operational Terminal Information System (D-OTIS), any web service that provides weather information and any web service that provides historic air traffic control (ATC) clearances.

The first module 218 is configured to integrate or combine the set of parameters 224 from the plurality of different external parameter sources 226 and to automatically determine or detect the visibility 222 at the particular airport 408. The combination of these parameters 224 or information contained in these parameters 224 is used to either partially or fully determine which geospatial low visibility information 238 is displayed on the airport moving map 206. The geospatial low visibility information 238 is considered to correctly determine the runway threshold affected by the low visibility route. The geospatial low visibility information considered includes depiction of the route and directional arrows leading to and from a particular runway and existence of a high intensive approach lighting system (ALS) and runway center line lights (RCLL) at the associated runway.

In accordance with an example, the system 202 includes a transceiver 228 or other device that is configured to receive the group of conditions 223 and the set parameters 224 or external parameters from the external parameter sources 226. In accordance with an embodiment, a query or queries 230 are generated by the airport moving map 206 and are transmitted to the external parameter sources 226 by the transceiver 228 for retrieving the parameters 224. Examples of the transceiver 228 or other device include an aircraft interface device (AID), an onboard network server (ONS), flight operations and maintenance exchanger (FOMAX) or similar device. The set of parameters 224 are received by the processor 208 from the transceiver 228.

The second module 220 is configured to perform a set of functions 232. In accordance with an embodiment, the set of functions 232 includes predicting a low visibility set-up options 204 for an airport moving map 206 for the particular airport 408 in response to the visibility 222 being below a predetermined value 233. The set of functions also includes retrieving the low visibility set-up option 204 from the data storage device 210 for the airport moving map 206 in response to predicting the low visibility set-up options 204. The set of functions 232 also includes applying 236 the low visibility set-up option 204 to the airport moving map 206 for the particular airport 408. Applying 236 the low visibility set-up option 204 includes overlaying geospatial low visibility information 238 on the airport moving map 206. The set of functions 232 additionally includes presenting 240 the airport moving map 206 on the display 216 including the geospatial low visibility information 238 included in the low visibility set-up option 204. Geospatial low visibility information 238 includes but is not necessarily limited to any runways, taxiways, aprons, terminal areas, parking stands, etc. that an Air Navigation Service Provider (ANSP) may define as a low visibility route. A low visibility route feature type includes low visibility routes and Surface Movement Ground Control System (SMGCS) routes. Low visibility routes ensure safe operations during low visibility approaches and take-offs. Low visibility routes define a route or series of routes that are used as common movement procedures between a terminal area and one or more runways. Additionally, low visibility routes are identified by additional lighting capabilities, and often have unique directionality for the route which can be different from the defined directionality of the underlying taxiways. Further, low visibility routes include a collection of directional lines at an airport that represent the desired movement of aircraft on the ground when weather or other conditions cause, for example, a pilot's view of the airport grounds to be reduced and air traffic control's (ATC) view of the aircraft and airport grounds to be reduced.

In accordance with an embodiment and as described in more detail with reference to FIGS. 3A-3B and FIGS. 5A-5D, predicting or determining the low visibility set-up option 204 for the airport moving map 206 includes predicting or determining multiple low visibility set-up options 502 (FIG. 5B) for the airport moving map 206 for the particular airport 520 in response to the visibility being below the predetermined value 233. A map filters panel 504 is presented on the display 216 that includes an identity 506 of each of the multiple low visibility set-up options 502 in response to activating a feature 508 in FIG. 5A to show the multiple low visibility set-up options 502 by a user. A certain low visibility set-up option 510 of the multiple low visibility set-up options 502 is automatically applied to the airport moving map 500 in response to the certain low visibility set-up option 510 being selected (e.g., placing a checkmark 512 in association with the certain low visibility set-up option 510) by the user from the multiple low visibility set-up options 502 in the map filters panel 504. In an example, automatically applying the certain low visibility set-up option 510 to the airport moving map 500 includes overlaying geospatial low visibility information 238 on the airport moving map 206, 500 based on the certain low visibility set-up option 510 or included in the certain low visibility set-up option 510.

Figure 3A:
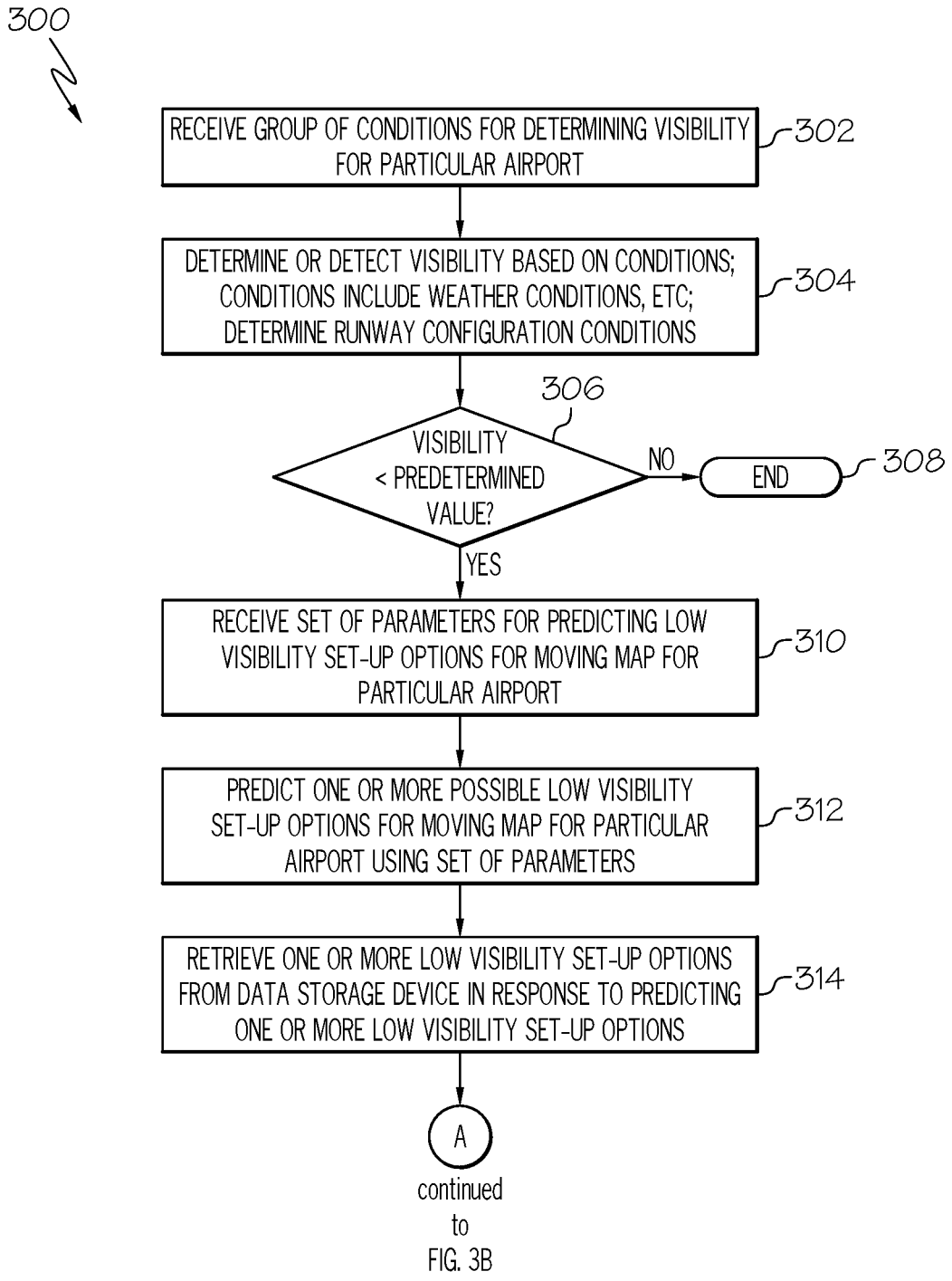
FIGS. 3A and 3B are a flow chart of an example of a method for predicting a low visibility set-up option for an airport moving map in accordance with an embodiment of the present disclosure.
Figure 3B:
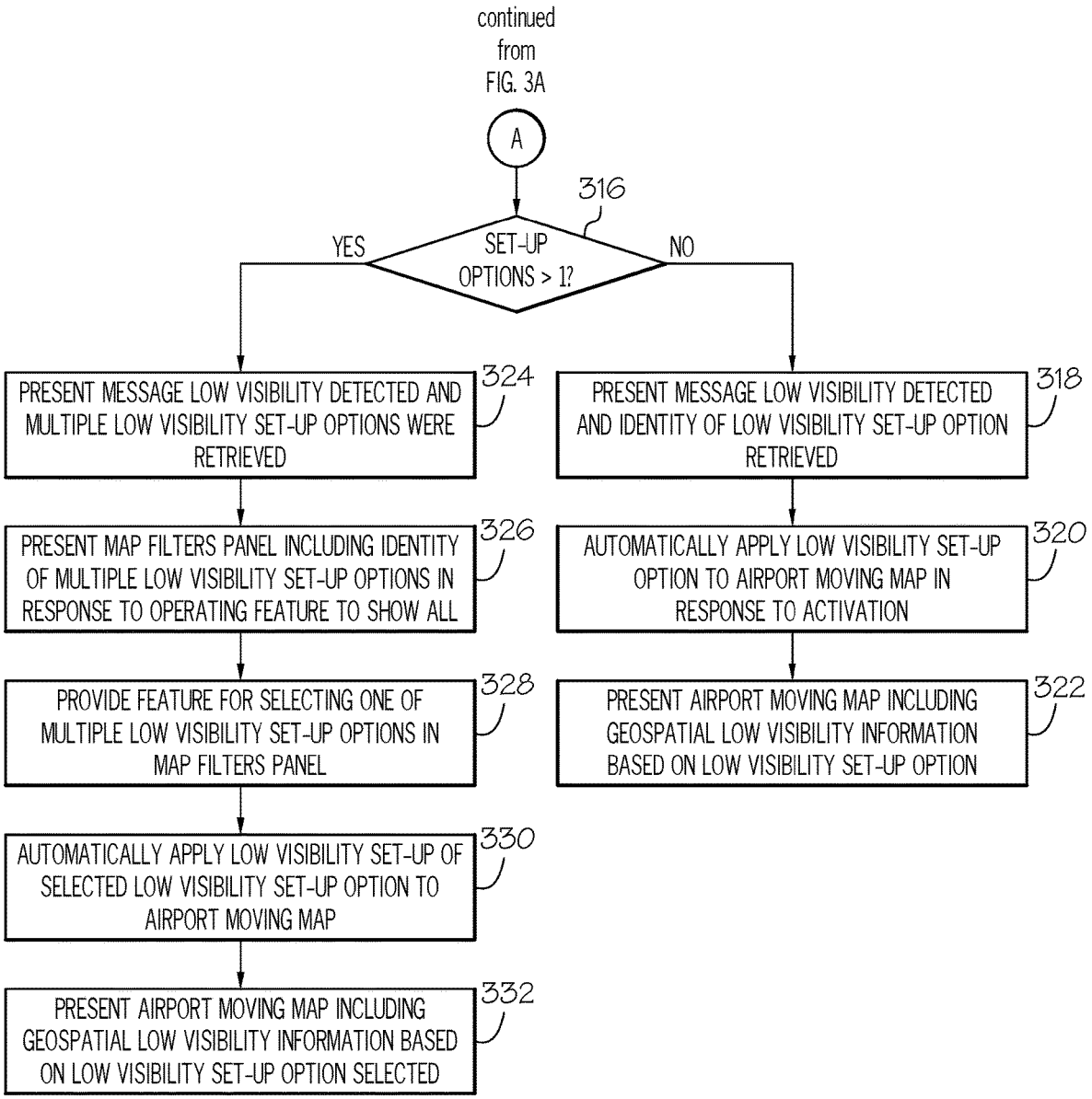

FIGS. 3A and 3B are a flow chart of an example of a method 300 for retrieving a low visibility set-up option for an airport moving map in accordance with an embodiment of the present disclosure. In accordance with an embodiment, the method 300 is embodied in and performed by the system 202 in FIG. 2. For example, the first module 218 and the second module 220 are configured to perform respective elements of the method 300. In block 302, a group of conditions is received for determining or detecting the visibility at a particular airport. In accordance with an example, the group of conditions includes at least weather conditions.

In block 304, a visibility at the particular airport is determined or detected based on conditions. Examples of the conditions include but are not necessarily limited to weather conditions. Runway configuration conditions are also determined. In the example in FIG. 2, the visibility 222 is determined or detected by the first module 218 operating on the processor 208. In block 306, a determination is made whether the visibility is below a predetermined value, for example, predetermined value 233 in FIG. 2. If the visibility is not below the predetermined value in block 306, the method 300 ends at termination 308. If the visibility is less than the predetermined value, the method advances to block 310.

In block 310, a set of parameters is received for predicting or determining the low visibility set-up options for the airport moving map for the particular airport. In accordance with the example in FIG. 2, the set of parameters 224 are retrieved from external parameter sources 226 by the system 202 in response to the visibility 222 being below the predetermined value 233.

In block 312, one or more low visibility set-up options for an airport moving map for the particular airport are predicted or determined in response to the visibility being below the predetermined value in block 306. In accordance with an example, multiple or all possible low visibility set-up options 502 (FIG. 5B) for the airport moving map for the particular airport are predicted using the set of parameters in response to the visibility being below the predetermined value in block 306. As previously described, examples of the set of parameters (e.g., parameters 224 in FIG. 2) include but are not necessarily limited to weather conditions at the particular airport 520 (FIGS. 5A-5D), a runway visual range at the particular airport 520, a phase of flight of the aircraft, an active runway or active runways at the particular airport 520, a type of aircraft 200, and a runway configuration or which combination of runways are currently active at the particular airport 520. The set of parameters are received from a source or sources, such as external parameter sources 226 in FIG. 1. The source includes at least one of a Digital Automatic Terminal Information Service (D-ATIS), an Automatic Dependent Surveillance Broadcast (ADS-B), a Meteorological Terminal Aviation Routine Weather Report (METAR), a Data Link Operational Terminal Information System (D-OTIS), a web service providing weather information and a web service providing historic air traffic control (ATC) clearances.

In block 314, the one or more low visibility set-up options are retrieved from a data storage device, such as data storage device 210 in FIG. 2, in response to predicting one or more low visibility set-up options. In accordance with the embodiment in FIG. 2, the one or more low visibility set-up options 204 are predicted and retrieved by the second module 220 running on the processor 208.

Figure 4A:
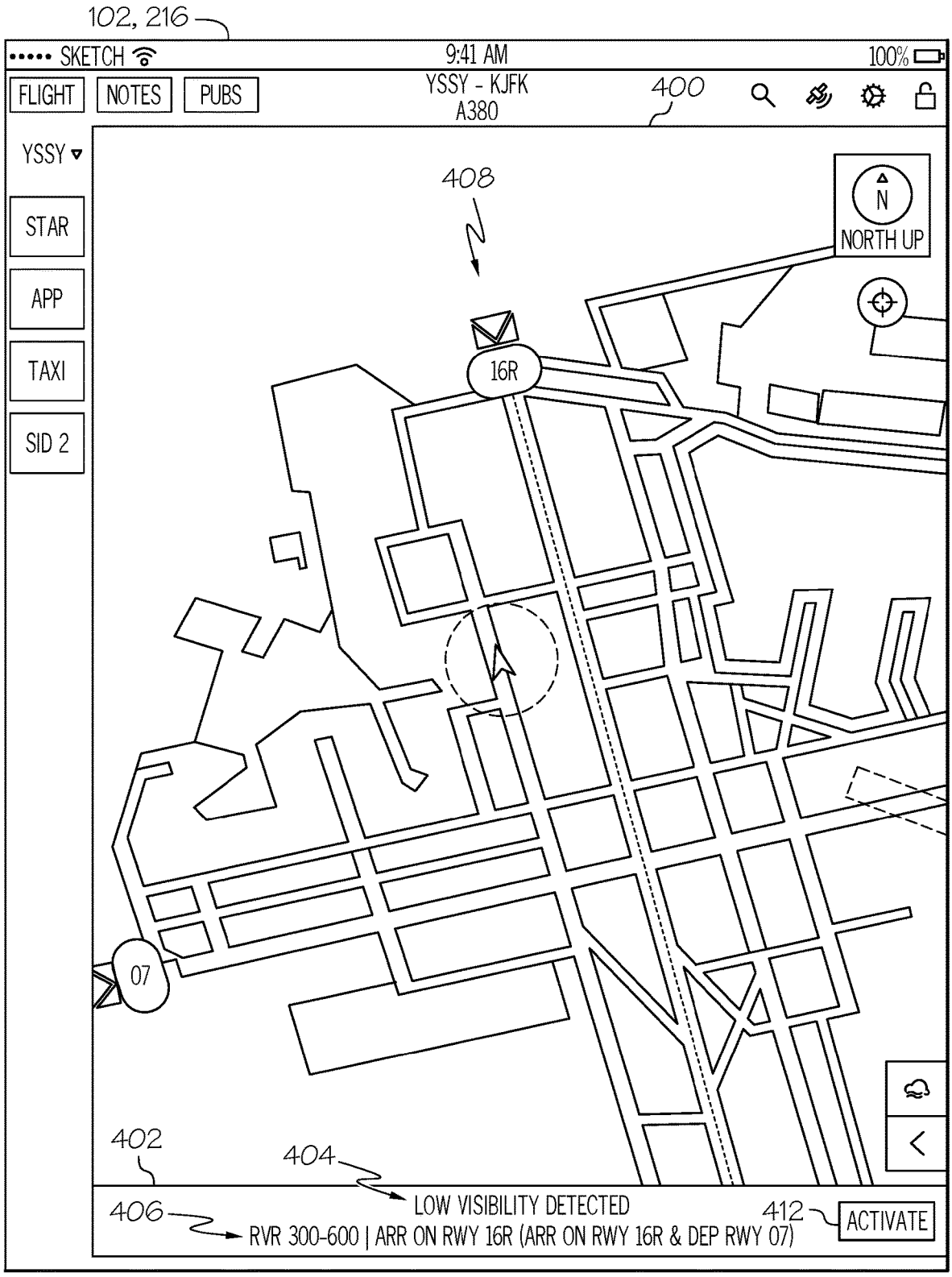
FIG. 4A is an illustration of an example of an airport moving map and presenting a message indicating a low visibility was detected and identifying one low visibility set-up option for a particular airport in accordance with an embodiment of the present disclosure.

In block 316, a determination is made if more than one low visibility set-up option was retrieved or found for the particular airport. If only one low visibility set-up option was found or retrieved, the method 300 advances to block 318. In block 318, a message is presented in response to the visibility being below the predetermined value and only one low visibility set-up option being retrieved from the data storage device, such as data storage device 210 in FIG. 2. In accordance with an example, the message indicates a low visibility was detected and presents an identity of the low visibility set-up option for the airport moving map for the particular airport. Referring also to FIG. 4A, FIG. 4A is an illustration of an example of an airport moving map 400 and presenting a message 402 indicating a low visibility 404 was detected and identifying one low visibility set-up option 406 for a particular airport 408 in accordance with an embodiment of the present disclosure. The airport moving map 400 and the message 402 are presented on a display, such as display 102 in FIG. 1 or display 216 in FIG. 2.

In block 320, the low visibility set-up option is applied to the airport moving map for the particular airport. In accordance with the embodiment illustrated in FIGS. 4A and 4B, the low visibility set-up option 406 is automatically applied to the airport moving map 400 for the particular airport 408 in response to selecting activation of the low visibility set-up option 406 for the airport moving map 400 by a user. In the example in FIG. 4A, the low visibility set-up option 406 is activated by the user selecting an activation feature, such as for example, an activate button 412.

Figure 4B:
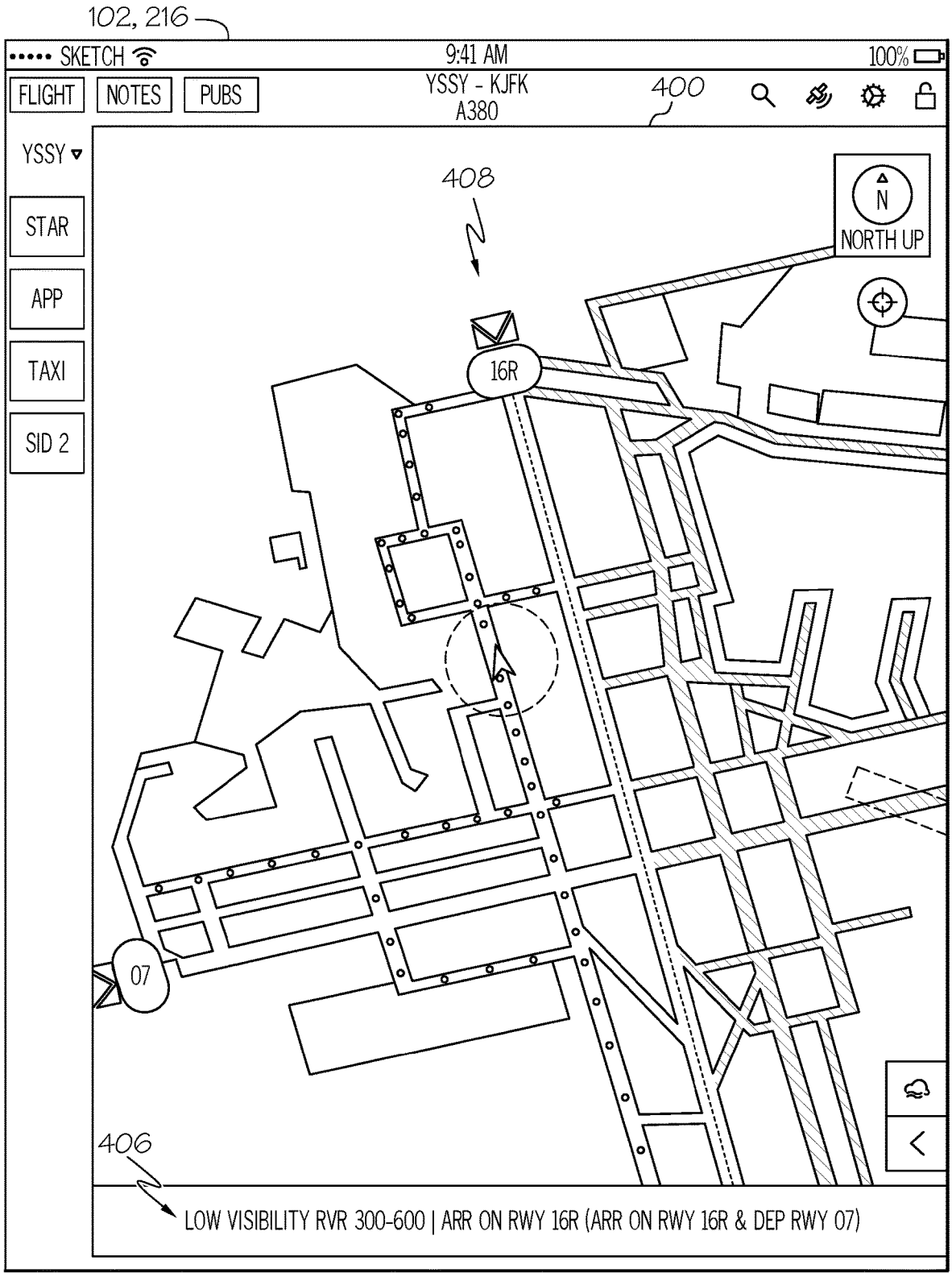
FIG. 4B is an illustrations of an example of applying the selected low visibility set-up option to an airport moving map for the particular airport in response to activation of the low visibility set-up option in accordance with an embodiment of the present disclosure.

In block 322, the airport moving map is presented on a display including geospatial low visibility information based on the low visibility set-up option. Referring also to FIG. 4B, FIG. 4B is an illustration of an example of automatically applying the low visibility set-up option 406 to the airport moving map 400 for the particular airport 408 in response to activation of the low visibility set-up option in accordance with an embodiment of the present disclosure.

Figure 5A:
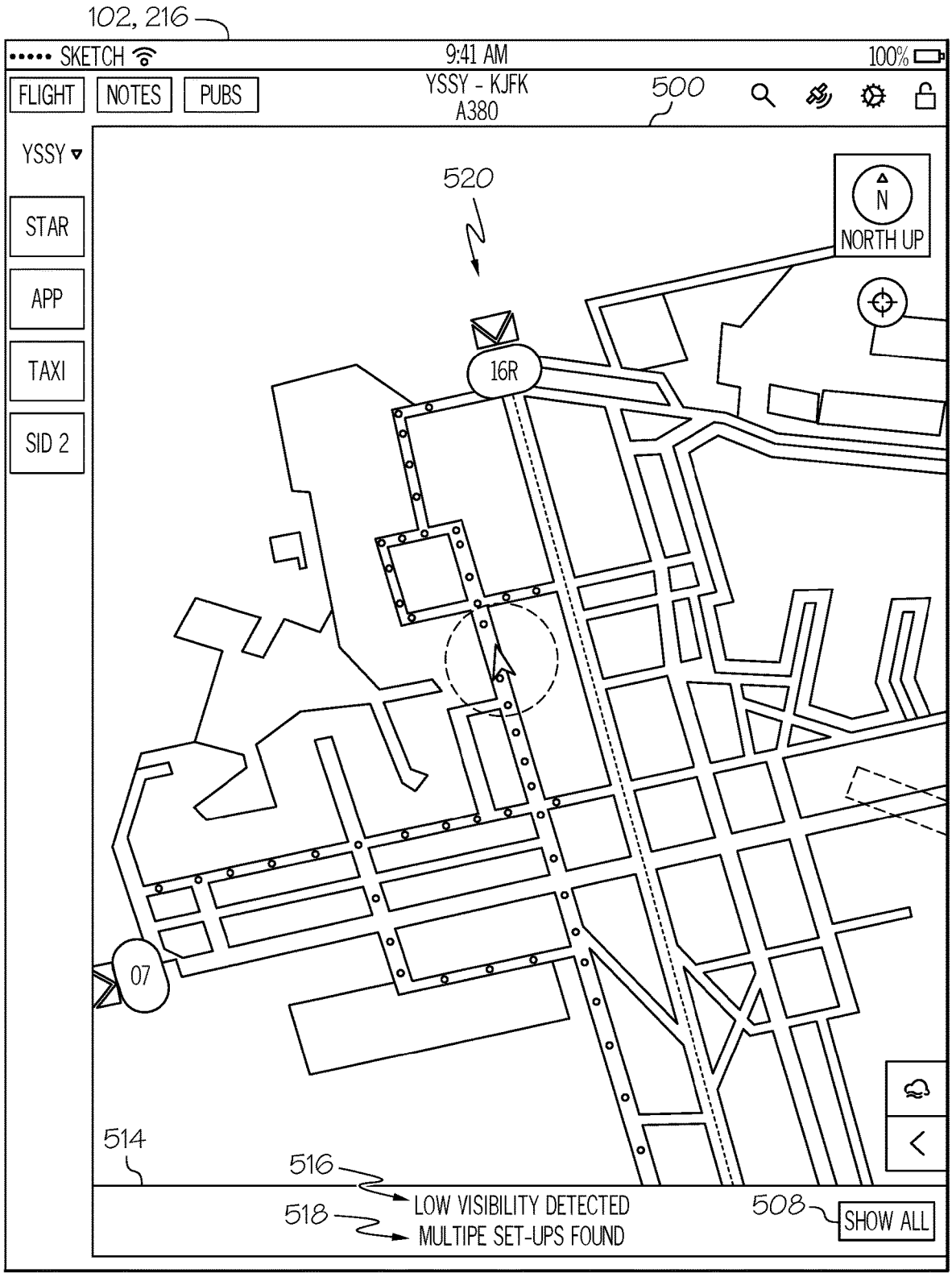
FIG. 5A is an illustration of an example of presenting a message that a low visibility was detected and that multiple low visibility set-up options for a particular airport were predicted and retrieved in accordance with an embodiment of the present disclosure.

Returning to block 316, if more than one low visibility set-up option was retrieved or found for the particular airport, the method 300 advances to block 324. In block 324, a message is presented indicating a low visibility was detected in response to the visibility being below the predetermined value. An indication is also presented that multiple low visibility set-up options were retrieved in response to more than one low visibility set-up option being predicted for the airport moving map for the particular airport. Referring also to FIG. 5A, FIG. 5A is an illustration of an example of presenting a message 514 that a low visibility was detected 516 and that multiple low visibility set-up options 518 for a particular airport were found in accordance with an embodiment of the present disclosure.

Figure 5B:
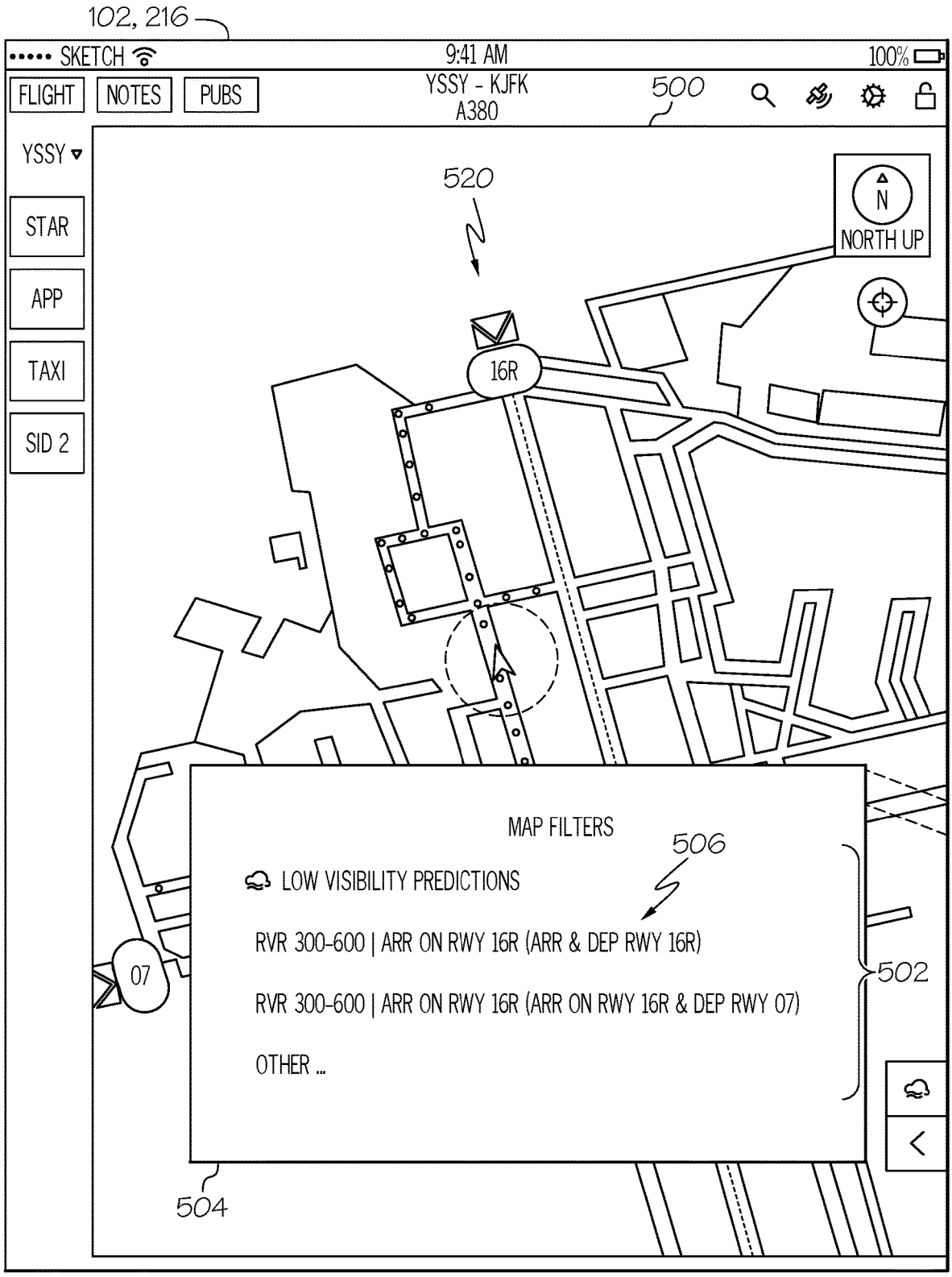
FIG. 5B is an illustration of an example of presenting a map filters panel for selecting one of the multiple low visibility set-up options for the particular airport in accordance with an embodiment of the present disclosure.

In block 326, a map filters panel is presented in response to activating a feature by a user to show all of the multiple low visibility set-up options. The map filters panel includes an identity of each of the multiple low visibility set-up options. Referring also to FIG. 5B, FIG. 5B is an illustration of an example of presenting a map filters panel 504 for selecting one of the multiple low visibility set-up options 502 for the particular airport 520 in accordance with an embodiment of the present disclosure. The map filters panel 504 is presented in response to activating the feature 508 in FIG. 5A by the user to show all of the multiple low visibility set-up options 502. In the example in FIG. 5A, the feature 508 is a button labeled "Show All." The map filters panel 504 includes an identity 506 of each of the multiple low visibility set-up options 502.

Figure 5C:
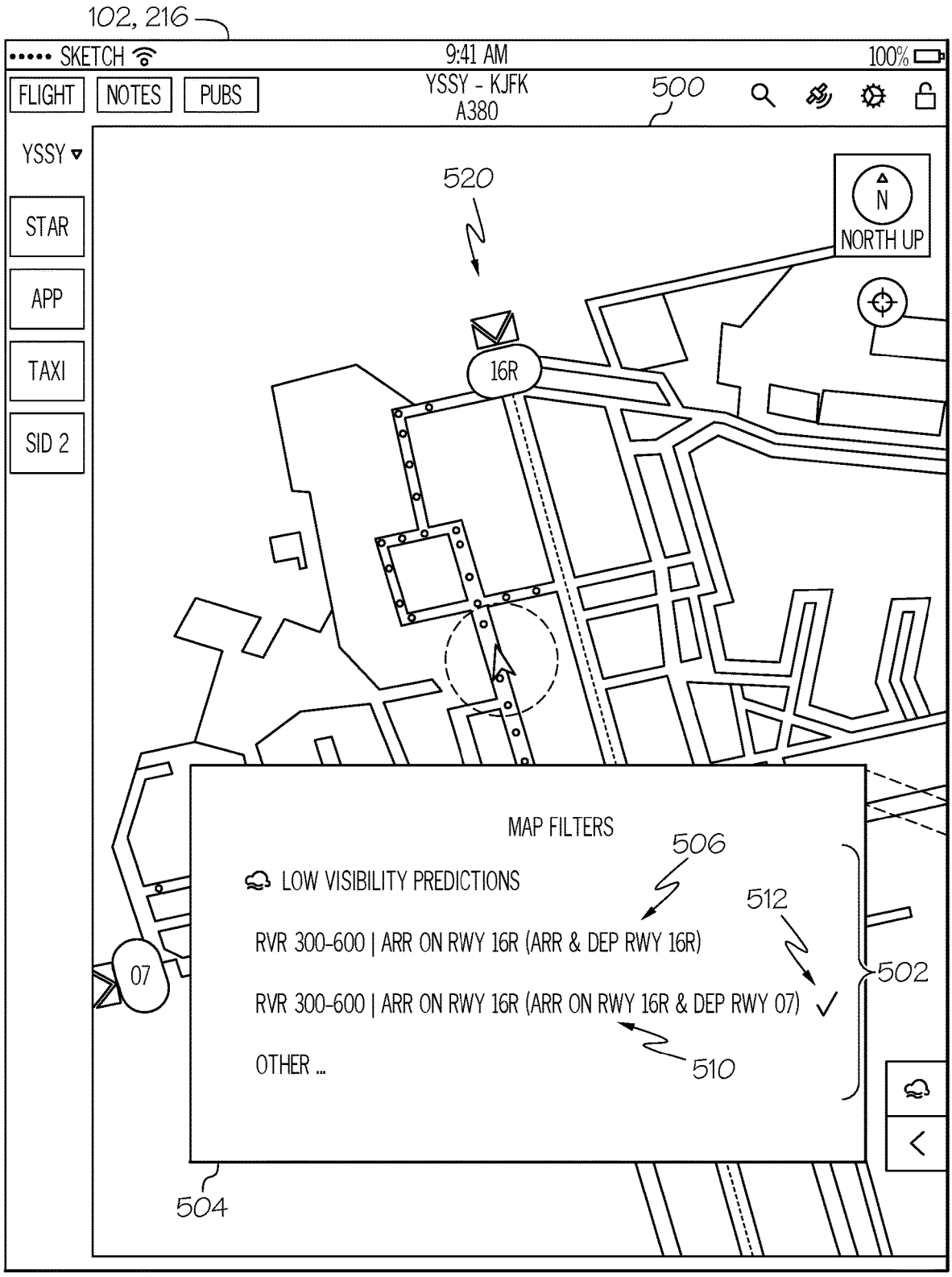
FIG. 5C is an illustration of an example of selecting one of the multiple low visibility set-up options for the particular airport in accordance with an embodiment of the present disclosure.

In block 328, a feature is provided for selecting one of the multiple low visibility set-up options in the map filters panel. Referring also to FIG. 5C, FIG. 5C is an illustration of an example of selecting one of the multiple low visibility set-up options 502 in the map filters panel 504 in accordance with an embodiment of the present disclosure. In the example in FIG. 5C, a certain low visibility set-up option 510 for the particular airport 520 is selected in the map filters panel 504. The certain low visibility set-up option 510 is selected from the multiple low visibility set-up options 502 in the map filters panel 504 by operating a computer pointing device or similar mechanism by the user (e.g., place a checkmark 512 in association with the certain low visibility set-up option 510).

In block 330, the certain low visibility set-up option 510 selected from the multiple low visibility set-up options 502 is automatically applied to the airport moving map 500 in response to the certain low visibility set-up option 510 being selected by the user from the multiple low visibility set-up options 502 in the map filters panel 504.

Figure 5D:
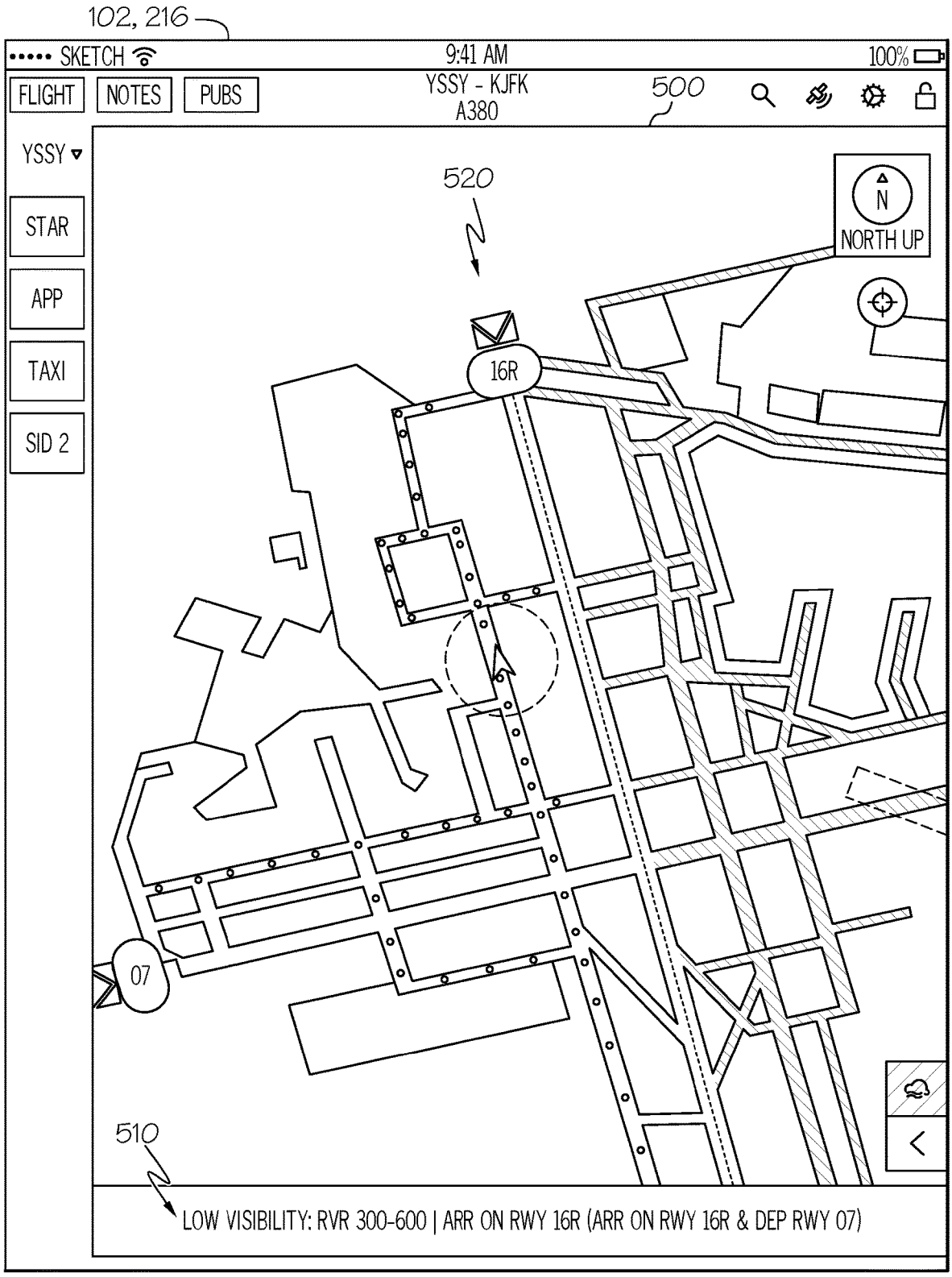
FIG. 5D is an illustration of an example of applying the selected one of the multiple low visibility set-up options for the particular airport to an airport moving map in accordance with an embodiment of the present disclosure.

In block 332, the airport moving map 500 is presented including the geospatial low visibility information 238 based on the certain low visibility set-up option 510 selected from the multiple low visibility set-up options 502. Referring also to FIG. 5D, FIG. 5D is an illustration of an example of applying the selected certain low visibility set-up option 510 of the multiple low visibility set-up options 502 for the particular airport 520 to the airport moving map 500 in accordance with an embodiment of the present disclosure.

The flowchart and block diagrams in the Figures illustrate the architecture, functionality, and operation of possible implementations of systems, methods, and computer program products according to various embodiments of the present disclosure. In this regard, each block in the flowchart or block diagrams may represent a module, segment, or portion of instructions, which comprises one or more executable instructions for implementing the specified logical function(s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

The terminology used herein is for the purpose of describing particular embodiments only and is not intended to be limiting of embodiments of the disclosure. As used herein, the singular forms "a", "an" and "the" are intended to include the plural forms as well, unless the context clearly indicates otherwise. It will be further understood that the terms "include," "includes," "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present embodiments has been presented for purposes of illustration and description, but is not intended to be exhaustive or limited to embodiments in the form disclosed. Many modifications and variations will be apparent to those of ordinary skill in the art without departing from the scope and spirit of embodiments.

Although specific embodiments have been illustrated and described herein, those of ordinary skill in the art appreciate that any arrangement which is calculated to achieve the same purpose may be substituted for the specific embodiments shown and that the embodiments have other applications in other environments. This application is intended to cover any adaptations or variations. The following claims are in no way intended to limit the scope of embodiments of the disclosure to the specific embodiments described herein.

What is claimed is:

1. A method for predicting a low visibility set-up option for an airport moving map, comprising:

determining, by a processor, a visibility at a particular airport;

predicting, by the processor, a low visibility set-up option for an airport moving map for the particular airport in response to the visibility being below a predetermined value;

retrieving, by the processor from a data storage device, the low visibility set-up option for the airport moving map in response to predicting the low visibility set-up;

applying, by the processor, the low visibility set-up option to the airport moving map for the particular airport;

presenting the airport moving map on a display including geospatial low visibility information based on the low visibility set-up option, wherein presenting the airport moving map including the geospatial low visibility information comprises overlaying a low visibility route or series of routes between an airport terminal and one or more runways on the airport moving map; and operating an aircraft using the airport moving map including the geospatial low visibility information.

2. The method of claim 1, further comprising receiving a group of conditions for determining the visibility at the particular airport.

3. The method of claim 2, wherein the group of conditions comprises weather conditions.

4. The method of claim 1, further comprising receiving a set of parameters for retrieving the low visibility set-up option for the airport moving map for the particular airport.

5. The method of claim 4, wherein predicting the low visibility set-up option comprises using the set of parameters, wherein the set parameters comprises a runway visual range, a phase of flight, an active runway or active runways, a type of aircraft, and a runway configuration.

6. The method of claim 5, wherein the set of parameters are received from a source comprising at least one of a Digital Automatic Terminal Information Service (D-ATIS), an Automatic Dependent Surveillance Broadcast (ADS-B), a Meteorological Terminal Aviation Routine Weather Report (METAR), a Data Link Operational Terminal Information System (D-OTIS), a web service providing weather information and a web service providing historic air traffic control (ATC) clearances.

7. The method of claim 1, further comprising:

presenting a message, the message indicating a low visibility was detected in response to the visibility being below the predetermined value;

presenting an identity of the low visibility set-up option for the airport moving map for the particular airport; and automatically applying the low visibility set-up option to the airport moving map for the particular airport in response to selecting activation of the low visibility set-up option for the airport moving map by a user.

8. The method of claim 1, wherein predicting the low visibility set-up option for the airport moving map comprises predicting multiple low visibility set-up options for the airport moving map for the particular airport in response to the visibility being below the predetermined value.

9. The method of claim 8, wherein predicting the multiple low visibility set-up options for the airport moving map comprises using a set of parameters, the set of parameters comprising a runway visual range, a phase of flight, an active runway or active runways, a type of aircraft, and a runway configuration.

10. The method of claim 8, further comprising:

presenting a message, the message indicating a low visibility was detected in response to the visibility being below the predetermined value; and presenting an indication that the multiple low visibility set-up options were retrieved from the data storage device in response to predicting more than one low visibility set-up option for the airport moving map for the particular airport.

11. The method of claim 10, further comprising:

presenting a map filters panel including an identity of each of the multiple low visibility set-up options retrieved from the storage device in response to activating a feature by a user to show the multiple low visibility set-up options; and automatically applying a certain low visibility set-up option of the multiple low visibility set-up options to the airport moving map in response to the certain low visibility set-up option being selected by the user from the multiple low visibility set-up options in the map filters panel.

12. A method for predicting a low visibility set-up option for an airport moving map, comprising:

determining, by a processor, a visibility at a particular airport;

predicting, by the processor, one or more low visibility set-up options for an airport moving map for the particular airport in response to the visibility being below a predetermined value, wherein predicting the one or more low visibility set-up options for the airport moving map comprises using a set of parameters, the set of parameters comprising a runway visual range, a phase of flight, an active runway or active runways, a type of aircraft, and a runway configuration;

retrieving, by the processor from a data storage device, the one or more low visibility set-up options for the airport moving map in response to predicting the one or more low visibility set-up options;

applying, by the processor, one low visibility set-up option of the one or more low visibility set-up options to the airport moving map for the particular airport;

presenting the airport moving map on a display including geospatial low visibility information based on the one low visibility set-up option, wherein presenting the airport moving map including the geospatial low visibility information comprises overlaying a low visibility route or series of routes between an airport terminal and one or more runways on the airport moving map; and operating an aircraft using the airport moving map including the geospatial low visibility information.

13. The method of claim 12, further comprising:

presenting a message, the message indicating a low visibility was detected in response to the visibility being below the predetermined value;

presenting an identity of a certain low visibility set-up option for the airport moving map for the particular airport in response to only the certain low visibility set-up option being predicted and retrieved; and automatically applying the certain low visibility set-up option to the airport moving map for the particular airport in response to selecting activation of the certain low visibility set-up option for the airport moving map by a user.

14. The method of claim 12, further comprising:

presenting a message, the message indicating a low visibility was detected in response to the visibility being below the predetermined value; and presenting an indication that multiple low visibility set-up options were retrieved in response to predicting more than one low visibility set-up option for the airport moving map for the particular airport.

15. The method of claim 14, further comprising:

presenting a map filters panel including an identity of each of the multiple low visibility set-up options in response to activating a feature to show the multiple low visibility set-up options by a user; and automatically applying a certain low visibility set-up option of the multiple low visibility set-up options to the airport moving map in response to the certain low visibility set-up option being selected by the user from the multiple low visibility set-up options in the map filters panel.

16. A system for predicting a low visibility set-up option for an airport moving map, comprising:

a processor;

a data storage device, the data storage device comprising a multiplicity of set-ups for airport moving maps;

a display for presenting the airport moving map;

a first module operable on the processor, the first module being configured to determine a visibility at a particular airport; and a second module operable on the processor, the second module being configured to perform a set of functions comprising:

predicting a low visibility set-up option for an airport moving map for the particular airport in response to the visibility being below a predetermined value;

retrieving, from a data storage device, the low visibility set-up option for the airport moving map for the particular airport in response to predicting the low visibility set-up option;

applying the low visibility set-up option to the airport moving map for the particular airport;

presenting the airport moving map on the display including geospatial low visibility information based on the low visibility set-up option, wherein presenting the airport moving map including the geospatial low visibility information comprises overlaying a low visibility route or series of routes between an airport terminal and one or more runways on the airport moving map; and operating an aircraft using the airport moving map including the geospatial low visibility information.

17. The system of claim 16, wherein the set of functions further comprises:

presenting a message, the message indicating a low visibility was detected in response to the visibility being below the predetermined value;

presenting an identity of the low visibility set-up option for the airport moving map for the particular airport; and automatically applying the low visibility set-up option to the airport moving map for the particular airport in response to selecting activation of the low visibility set-up option for the airport moving map by a user.

18. The system of claim 16, wherein predicting the low visibility set-up option for the airport moving map comprises predicting multiple low visibility set-up options for the airport moving map for the particular airport in response to the visibility being below the predetermined value.

19. The system of claim 18, wherein the set of functions further comprises:

presenting a message, the message indicating a low visibility was detected in response to the visibility being below the predetermined value; and presenting an indication that the multiple low visibility set-up options were retrieved in response to predicting more than one low visibility set-up option for the airport moving map for the particular airport.

20. The system of claim 19, wherein the set of functions further comprises:

presenting a map filters panel including an identity of each of the multiple low visibility set-up options in response to activating a feature to show the multiple low visibility set-up options by a user; and automatically applying a certain low visibility set-up option of the multiple low visibility set-up options to the airport moving map in response to the certain low visibility set-up option being selected by the user from the multiple low visibility set-up options in the map filters panel.

* * * * *